US009919767B2

(12) United States Patent
Reid et al.

(10) Patent No.: US 9,919,767 B2
(45) Date of Patent: Mar. 20, 2018

(54) WIND BLOCK DOOR FOR COMPANIONWAY HATCH

(71) Applicant: Protomet Corporation, Oak Ridge, TN (US)

(72) Inventors: William Matthew Reid, Knoxville, TN (US); Dale Lee Lambert, Oak Ridge, TN (US); Michael Shane Garner, Philadelphia, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 15/215,779

(22) Filed: Jul. 21, 2016

(65) Prior Publication Data

US 2018/0023331 A1 Jan. 25, 2018

(51) Int. Cl.
*B63B 19/18* (2006.01)
*B63B 43/28* (2006.01)

(52) U.S. Cl.
CPC ..... *B63B 19/18* (2013.01); *B63B 43/28* (2013.01); *E05Y 2201/624* (2013.01); *E05Y 2900/514* (2013.01)

(58) Field of Classification Search
CPC ..... B63B 43/28; B63B 19/18; B63B 19/19; B63B 19/12; B63B 19/145; B63B 19/14; B63B 19/21; E05D 15/06; E05D 15/0617; E05D 3/186; E05Y 2900/514
See application file for complete search history.

(56) References Cited

U.S. PATENT DOCUMENTS 3,745,957 A * 7/1973 Hendrickson ..... B63B 19/18 114/202
4,104,827 A * 8/1978 Opron ..... B60J 1/14 49/362
4,815,797 A * 3/1989 Haab ..... E05D 15/58 312/322
4,833,829 A * 5/1989 Wilson ..... B63B 19/08 114/202
4,911,219 A * 3/1990 Dalrymple ..... B61D 17/20 160/118
5,088,435 A * 2/1992 Lathers ..... B63B 19/18 114/177
5,121,976 A * 6/1992 Haab ..... E05D 15/58 312/322
5,149,180 A * 9/1992 Haab ..... E05D 15/58 312/322

(Continued)

*Primary Examiner* — Justin B Rephann
(74) *Attorney, Agent, or Firm* — Knox Patents; Thomas A. Kulaga

(57) ABSTRACT

Apparatus for a door for a boat's companionway hatch. The door includes a frame, a door, a drive mechanism, and a receiver. The drive mechanism moves the door between an open and closed position to selectively allow and block access to a bulkhead opening in the companionway. In the open position, the edge of the door is substantially parallel with the companionway sidewall. In the closed position the edge of the door engages the receiver and the edge is substantially parallel with the sidewall to which the receiver is attached. The drive mechanism includes a pair of struts that are driven by an actuator to move with a scissors-like motion. One end of each strut is fixed in position. The opposite end of each strut has a roller that moves within a slot, with one slot in the door and the other slot in the frame.

19 Claims, 6 Drawing Sheets

(56) References Cited

U.S. PATENT DOCUMENTS

| | | | | |
|---|---|---|---|---|
| 5,224,297 | A * | 7/1993 | Watkins | E05B 17/04 292/210 |
| 6,131,340 | A * | 10/2000 | Clark | B63B 43/24 114/202 |
| 7,308,973 | B2 * | 12/2007 | Dziwak | B66B 13/06 160/84.09 |
| 9,199,703 | B1 * | 12/2015 | Svendsen | B63B 43/26 |
| 9,688,358 | B2 * | 6/2017 | Fuller, IV | B63B 19/18 |
| 2006/0145007 | A1 * | 7/2006 | Melberg | B64C 1/1469 244/118.5 |
| 2007/0033879 | A1 * | 2/2007 | Erskine | B63B 19/00 49/410 |
| 2007/0068435 | A1 * | 3/2007 | Martin | B63B 19/18 114/117 |
| 2007/0186838 | A1 * | 8/2007 | Mercier | B63B 19/00 114/361 |
| 2009/0078824 | A1 * | 3/2009 | Osborne | B64D 11/0023 244/119 |
| 2012/0228429 | A1 * | 9/2012 | Hanson | B64C 1/1469 244/129.5 |
| 2012/0285357 | A1 * | 11/2012 | Gros | B63B 9/04 114/203 |
| 2013/0111835 | A1 * | 5/2013 | Harter | E04B 2/74 52/238.1 |
| 2014/0117161 | A1 * | 5/2014 | Harter | B64D 11/0023 244/129.5 |
| 2015/0232151 | A1 * | 8/2015 | Fuller, IV | B63B 19/18 114/117 |

* cited by examiner

WIND BLOCK DOOR FOR COMPANIONWAY HATCH

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

1. Field of Invention

This invention pertains to a door for a vessel's companionway hatch. More particularly, this invention pertains to a powered door for a boat's companionway hatch.

2. Description of the Related Art

A companionway is a hatch, or opening, in a boat, or marine, vessel. The companionway is a passage for people between the exterior, typically the cockpit, and interior of the boat, typically the cabin. The companionway, when covered, also serves to keep water out of the boat's interior. Generally, hatch is a nautical term that refers both to an opening in a boat and to the cover of that opening.

Typically, a companionway includes a top hatch, or opening, and a bulkhead hatch, or opening. The top hatch is an opening in the deck. The bulkhead hatch is an opening in the bulkhead that abuts the deck. The top hatch or opening is typically sealed with a sliding hatch and the bulkhead hatch is sealed with sliding washboards.

The bulkhead opening between the cockpit and the cabin typically has tapered companionway sides. Sliding washboards slide into a slot on each side. The tapered sides allows each washboard to be lifted only a short distance to disengage from the bulkhead opening. This configuration allows for the bulkhead opening to be sealed against inclement weather and boarding seas, but at the expense of the inconvenience of lifting the boards and having to stow them when the companionway is to be used.

BRIEF SUMMARY

According to one embodiment of the present invention, a powered companionway door system for a bulkhead opening is provided. The door system includes a door, a frame, a drive mechanism, and a receiver. The door is configured to fit in a companionway bulkhead hatch when in the closed position and to retract completely when in the open position. The door is attached to the drive mechanism and is operated by a switch. The drive mechanism includes a scissors mechanism with a drive actuator. The scissors mechanism moves the door in an arcuate path so that the distal end of the door fits flush with the sides of the companionway hatch in both the open and closed position. In the closed position, the receiver holds captive the distal end of the door in a receiver recess or slot.

In one embodiment, the door includes a door slot and the frame includes a frame slot. The scissors mechanism includes a pair of struts. One end of the first strut is pivotally attached to the inside end of the door and the other end of the first strut engages the frame slot with a first roller. One end of the second strut is pivotally attached to the frame and the other end of the second strut engages the door slot with a second roller. The pair of struts are connected with a medially positioned point of rotation. The struts rotating relative to each other causes the door to move between the open and closed position. The longitudinal axis of the door slot moving between the open and closed position describes an arc that subtends an angle substantially equal to the angle between the companionway sidewalls.

The drive mechanism includes an actuator. The actuator includes a drive with a rotating output that defines the point of rotation of the pair of struts. The drive is attached to one strut and the rotating output is attached to the other strut such that the two struts rotate relative to each other when the drive is energized. In one embodiment the actuator includes a motor and a gear reduction unit. An open limit switch detects when the door is in the open position and causes the actuator to be de-energized. A closed limit switch detects when the door is in the closed position and causes the actuator to be de-energized. Open and closed are in reference to the position of the door. An operating switch allows for a person to manually initiate the door to open or close by energizing the actuator such that the struts rotate in the desired direction. In various embodiments the operating switch is mounted on the frame and/or remotely.

In one embodiment, the door system includes a lock that secures the door in the closed position. A locking mechanism is attached to the frame. The locking mechanism includes a latching solenoid with a plunger that engages a hole in the door when the door is in the closed position. To open the door, the locking mechanism is actuated to retract the plunger, thereby freeing the door to move laterally. In another embodiment the locking mechanism also secures the door in the open position by having the plunger engage a second hole that is aligned with the plunger when the door is in the open position. To avoid water intrusion into the vessel with the door closed, the hole for locking the door in the open position is a blind hole.

In one embodiment, the door system includes guides for the door. The guides are strips of material that line the opening in the frame and the receiver slot. The strips provide a bearing surface for the door to slide against when moving. The strips also provide damping to minimize vibration and movement of the door against the frame opening and the receiver slot, such as would occur when under way.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for an automated door system is disclosed. The door system is generally indicated as 100. Various components are illustrated both generically and specifically in the figures and in the following description. For example, the struts 212-A, 212-B are discussed individually and separately to ensure clarity when describing the configuration of each strut 212-A, 212-B. The struts 212, when referred to collectively, are referenced without the alphanumeric suffix.

Figure 1:
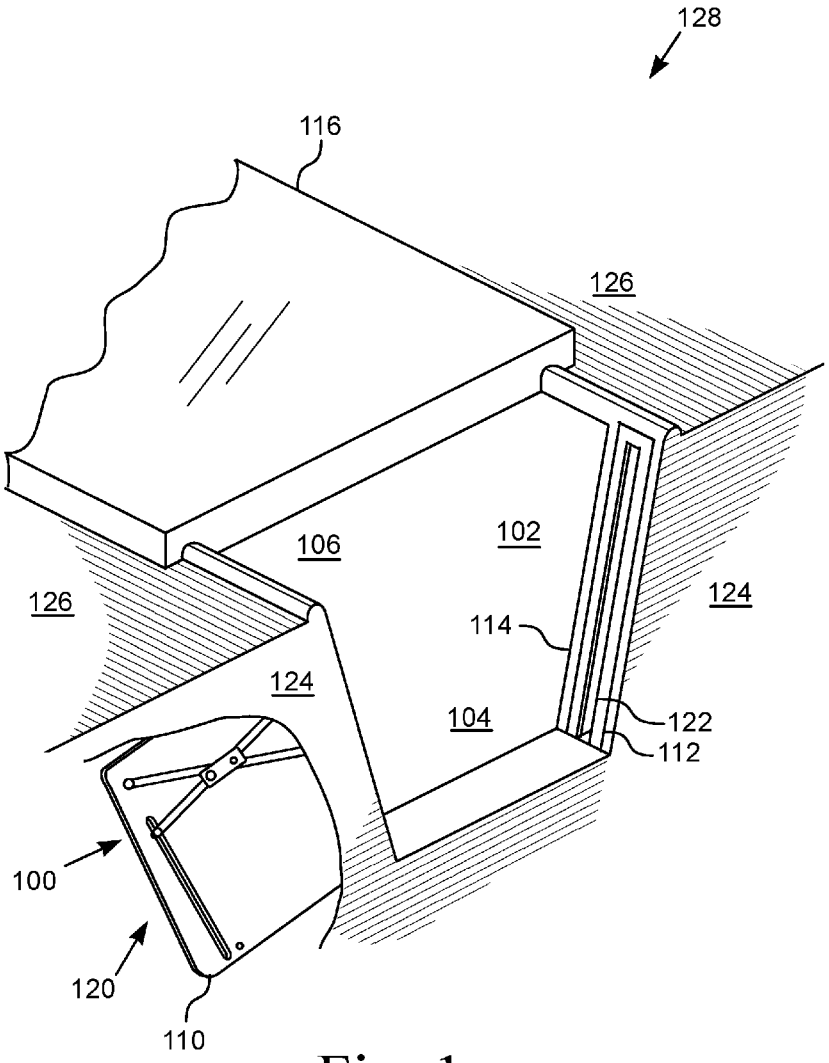
FIG. 1 is a partial cross-sectional view of a boat's companionway with one embodiment of a door system in the open position.

FIG. 1 illustrates a partial cross-sectional view of a boat's companionway 102 with one embodiment of a door system 100 shown in the open position. The companionway 102 includes a deck opening 106 and a bulkhead opening 104. The deck opening 106 is contiguous with the deck 126. The bulkhead opening 104 is in an aft-facing bulkhead 124, such as a wall separating an interior cabin from a cockpit in a boat 128.

The deck opening 106 of the companionway 102 has a cover 116 configured to slide between an open and closed position. The bulkhead opening 104 of the companionway 102 has a door 110 that moves between an open and closed position. With the sliding cover 116 and the door 110 both in the closed position the interior of the boat 128 is protected from the elements.

The illustrated bulkhead opening 104 is a tapered opening with a pair of opposed companionway sidewalls 114. The sidewall 114 opposite where the door 110 is stowed in the open position includes a receiver 112. The receiver 112 includes a receiver slot 122 into which the distal end 610 of the door 110 fits when the door 110 is in the closed position. In one embodiment, the companionway sidewalls 114 each have a recess that receives the receiver 112 and the frame plate 216 such that the sidewalls 114 form a planar surface, that is, the receiver 112 and frame plate 216 have an outer surface that is flush with the adjacent surface of the sidewalls 114.

The door system 100 includes the door 110, its drive mechanism 120, and the receiver 112. The drive mechanism 120 operates to move the door 110 between the open and closed positions. The door 110 is a rigid, planar panel that is dimensioned to extend to the opposite companionway sidewall 114 and engage the slot 122 in the receiver 112 when the door 110 is in the closed position.

In another embodiment, the door system 100 is inset inside a weather-tight companionway door and blocks wind from entering the cabin of the boat 128. In such an embodiment, the door system 100 does not have a weather-tight configuration and is intended to be used with the weather-tight companionway door removed. In such an embodiment, the door system 100 protects against wind, inclement weather, and intrusion into the vessel 128.

Figure 2:
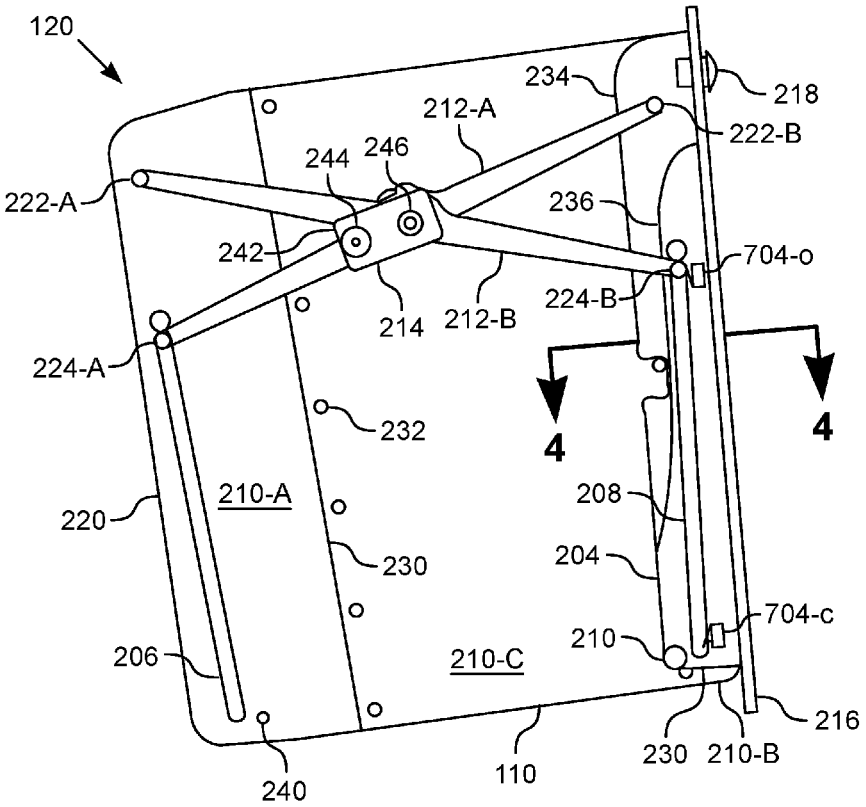
FIG. 2 is a view of one embodiment of a door system in the open position.

FIG. 2 illustrates a view of one embodiment of a door system 100 in the open position. The illustration shows the drive mechanism 120, the door 110, and a frame 204. With the door 110 in the open position, the distal edge 610 of the door 110 is flush with, or slightly inset to, the outer surface of the frame plate 216.

The drive mechanism 120 includes a pair of struts 212-A, 212-B, an actuator 214, and a pair of slots 206, 208. The struts 212 move relative to each other by way of the actuator 214 attached medially. Each strut 212-A, 212-B has one end attached to a pivot 222-A, 222-B. The opposite end of each strut 212-A, 212-B engages one of the slots 206, 208 with a roller 224-A, 224-B. In one embodiment, the drive mechanism 120 includes two pairs of struts 212 with one pair on one side of the door 110 and the other pair of struts 212 on the other side of the door 110. In such an embodiment the actuator 214 is connected to one pair of struts 212 and the other pair of struts 212 have a pivoting connection opposite the actuator 214 on the other side of the door 110. In one embodiment with two pairs of struts 212, a single roller 224-A connects the strut 212-A on each side of the door.

The first strut 212-A has one end attached to a roller 224-A that engages the slot 206 in the door 110. The slot 206 is near an edge 210 of the door 110 and has an enlarged end sized to receive the roller 224-A, which is then held captive in the slot 206. The roller 224-A is constrained to freely move along the slot 206 as the door 110 moves between the open and closed positions. The other end of the strut 212-A is connected to the frame 204 at a pivot 222-B. The pivot 222-B connects an end of the strut 212-A at a fixed point on the frame 204 and allows the strut 212-A to freely rotate relative to that fixed point. The pivot 222-B also supports the strut 212-A away from the surface of the door 110. In one embodiment, the pivot 222-B has a bearing to aid the rotation of the strut 212-A relative to the frame 204.

The second strut 212-B has one end connected to a pivot 222-A. The pivot 222-A connects an end of the strut 212-B at a fixed point near the edge 220 of the door 110 while allowing the strut 212-B to freely rotate relative to that fixed point. The pivot 222-A also supports the strut 212-B away from the surface of the door 110. In one embodiment, the pivot 222-A has a bearing to aid the rotation of the strut 212-B relative to the door 110. The other end of the strut 212-B is attached to a roller 224-B that engages a slot 208 in the frame 204. The roller 224-B is constrained to freely move along the slot 208 as the door 110 moves between the open and closed positions. The slot 208 has an enlarged end sized to receive the roller 224-B, which is then held captive in the slot 208.

The actuator 214, in the illustrated embodiment, includes a housing 242, a drive motor 244, and an output 246. The actuator 214 is connected to the pair of struts 212-A, 212-B. The actuator 214 includes a gear reduction unit between the motor 244 and the output 246. The housing of the actuator 214 is attached to one of the two struts 212-A, 212-B and the output 246 of the gear reduction unit is attached to the other strut 212-B, 212-A. In this way the actuator 214 causes the two struts 212-A, 212-B to rotate relative to each other, thereby providing motive force to open and close the door 110 as desired. The output 246 defines the center of rotation of the struts 212-B, 212-A.

The frame 204 includes a frame plate 216. The frame plate 216 is configured to attach to one companionway sidewall 114 that has an opening for passage of the door 110. The frame plate 216 is bolted, screwed, or otherwise fixed to the sidewall 114. In one embodiment the frame plate 216 engages a recess in the sidewall 114 such that the outer surface of the frame plate 216 is flush with the adjacent sidewall 114. In another embodiment the frame plate 216 is attached to the inside surface of the sidewall 114 and appropriate trim is used for the opening in the sidewall 114 that the door 110 passes through.

A switch 218 extends from the frame plate 216. In the illustrated embodiment, a single switch 218 operates the door system 100. In one embodiment a pair of switches extend from the frame plate 216 with one switch 218 on each side of the door 110. In this way the door 110 can be opened from either side of the bulkhead 124. In another embodiment, the switches 218 are located at another convenient location for operating the door system 100.

The door 110 includes a removable center panel 210-C that allows for passage through the bulkhead opening 104 of the companionway 102 for maintenance or other reasons, such as when power to the door system 100 is not available. The center panel 210-C is attached with a lap joint 230 to panels 210-A, 210-B on either side of the center panel 210-C. Fasteners 232 secured the center panel 210-C to the other panels 210-A, 210-B. Removal of the fasteners 232 allows the center panel 210-C to be removed from the door system 100, even when the distal edge 610 of the door 110 is engaging the receiver 112.

In the illustrated embodiment, the door 110 is shown as a flat panel. In other embodiments the door 110 includes ornamental designs or features, such as molded, machined, or etched elements.

Attached to the frame 204 is a locking mechanism 210. In the illustrated embodiment the locking mechanism 210 is an electric solenoid with a plunger 410 that engages a hole 240 in the door. The hole 240 aligns with the locking mechanism 210 when the door 110 is in the closed position. In this way the door system 100 is securable when closed, preventing unauthorized entry to the boat 128. In one embodiment the locking mechanism 210 is a latching device. The mechanism 210 has two positions, locked and unlocked, and it changes position when energized.

Figure 3:
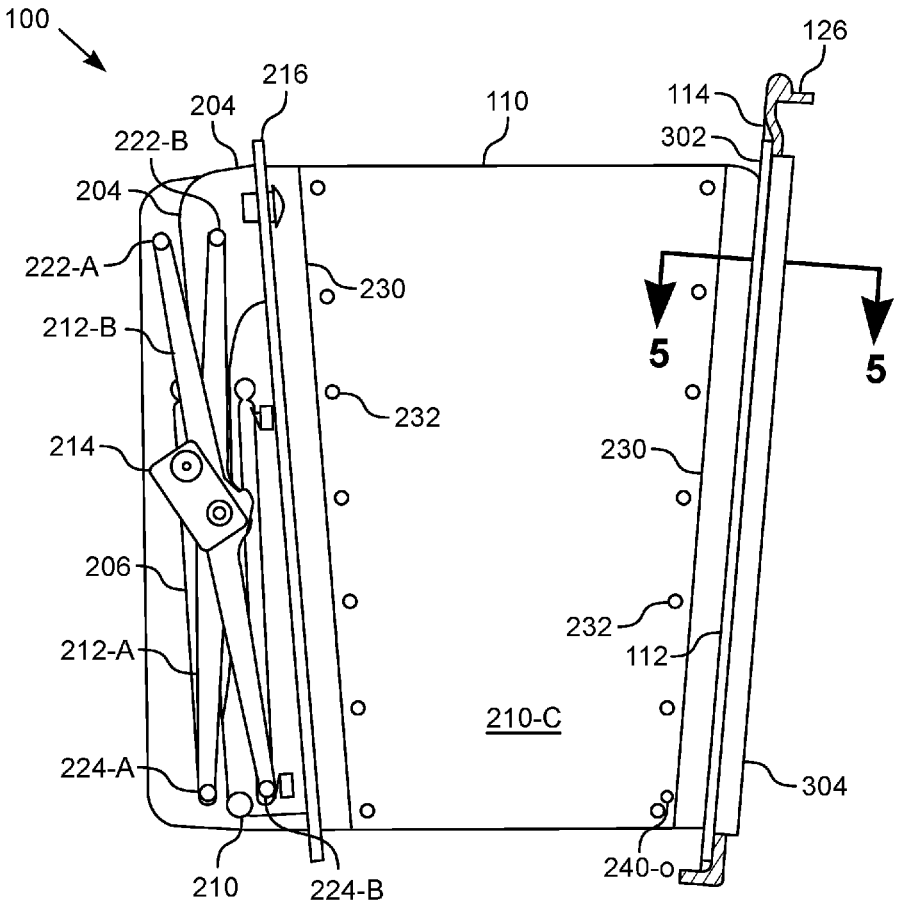
FIG. 3 is a view of one embodiment of a door system in the closed position.

FIG. 3 illustrates a view of one embodiment of a door system 100 in the closed position. The door 110 is shown with the distal edge 610 engaging the receiver 112. The receiver 112 is shown inserted in a recess in a companionway sidewall 114. The exposed surface of the receiver plate 302 is flush with the surface of the companionway sidewall 114. In one embodiment, the frame plate 216 is attached to the corresponding companionway sidewall 114 in a similar manner as the receiver 112.

When the door 110 is in the closed position, the distal edge 610 of the door 110 is substantially parallel with the outside surface of the receiver plate 302. The struts 212-A, 212-B are shown with the pivots 222-A, 222-B close together, as are the rollers 224-A, 224-B. In the illustrated embodiment, the struts 212-A, 212-B rotate about the actuator output 246, and the distance between the pivots 222-A, 222-B is equal to the distance between the rollers 224-A, 224-B because the distance from the center of rotation (the actuator output 246) of the struts 212-A, 212-B is equidistant to each of the pivots 222-A, 222-B and rollers 224-A, 224-B. In other embodiments, the pivots 222-A, 222-B and rollers 224-A, 224-B are not equidistant from the actuator output 246. That is, in such embodiments the actuator output 246 is not centered between pivots 222-A, 222-B and rollers 224-A, 224-B.

A second locking hole 240-*o* is shown in FIG. 3. When the door 110 is in the open position, the open locking hole 240-*o* is aligned with the locking mechanism 210, thereby securing the door in the open position.

Figure 4:
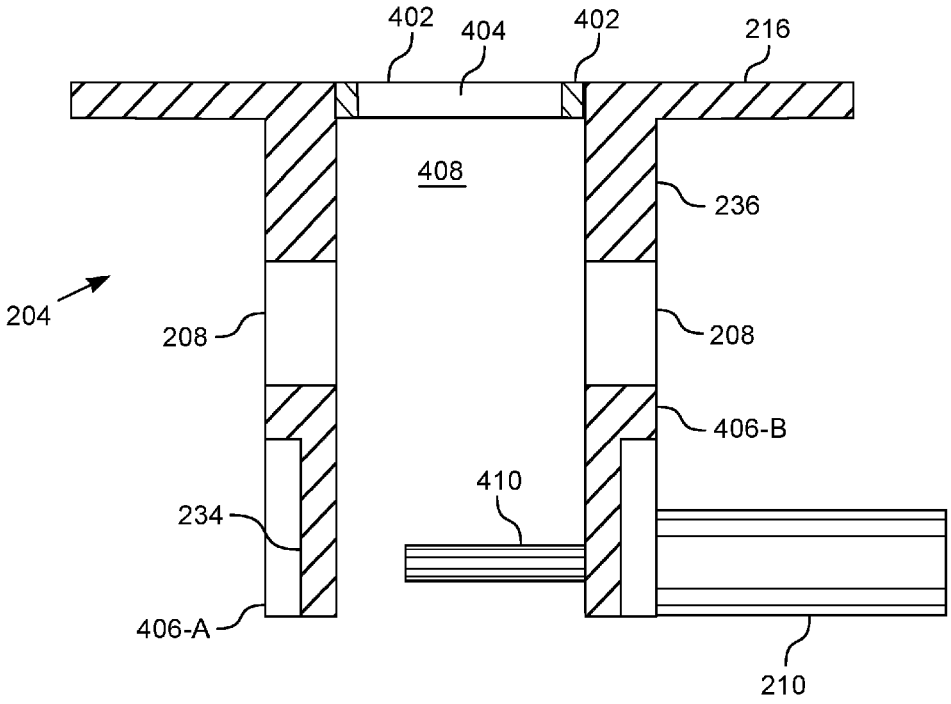
FIG. 4 is a cross-sectional view of one embodiment of a frame.

FIG. 4 illustrates a cross-sectional view of one embodiment of a frame 204. The frame 204 includes a frame plate 216 and a pair of side supports 406-A, 406-B. The illustrated embodiment of the frame 204 is configured to accommodate two pairs of struts 212, with one pair of struts 212-A, 212-B connected to one side support 406-B and the other pair of struts 212 connected to the other side support 406-A on the other side of the door 110. In another embodiment, a single pair of struts 212-A, 212-B are connected to one side support 406-B.

The frame plate 216 is a member configured to attach to the bulkhead sidewall 114 that is adjacent the drive mechanism 120. The frame plate 216 includes an opening 404 dimensioned to receive the door 110. Surrounding the inside of the opening 404 is a guide 402. The guide 402 provides a bearing surface for the door 110 as the door 110 passes through the frame plate 216. In various embodiments the guide 402 is a polyethylene material, such as a high-density polyethylene material or an ultra-high-molecular weight polyethylene (UHMW) material. Such material provides good wear resistance and a low coefficient of friction, allowing easy engagement of the door 110 with the frame plate 216. The guide 402 is dimensioned to provide a close fit with the door 110. In this way, vibrations, rattling, or other movement of the door 110 while under way are minimized.

The side supports 406 extend from the frame plate 216 toward the edge 220 of the door 110. The side supports 406-A, 406-B are separated by a gap 408 sized to accommodate the thickness of the door 110. Each side support 406-A, 406-B has two regions 234, 236 of different thicknesses. The thicker portion 236 includes the slot 208 in which the roller 224-B moves. The pivot 222-B connects to the thinner section 234. In this way the first strut 212-A is offset closer to the door 110 than the second strut 212-B, which is offset further way from the door 110. This allows the struts 212-A, 212-B to be stacked and rotate freely relative to each other. The difference in the thickness of the portions 234, 236 is the same or slightly greater than the thickness of the inside strut 212-A.

The locking mechanism 210 is attached to one side support 406-B. The locking mechanism 210 includes a plunger 410 that engages a hole 240, 240-*o* near the edge 220 of the door 110. The plunger 410 is shown in the extended or locked position. When the door 110 is not locked the plunger 410 is retracted into the locking mechanism 210. In the illustrated embodiment, the locking mechanism 210 is positioned outboard of the door 110. In another embodiment, the locking mechanism 210 is located inboard of the door 110.

Figure 5:
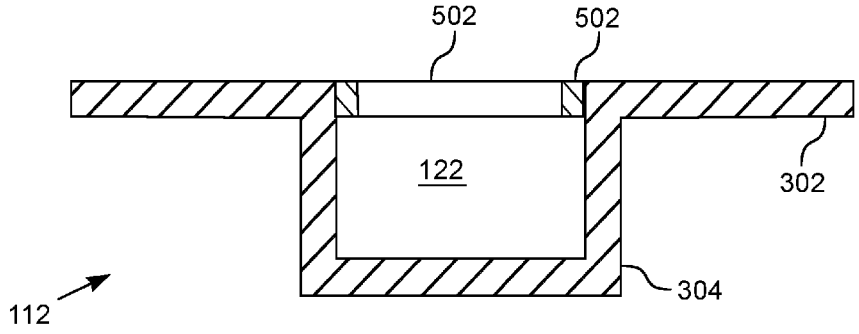
FIG. 5 is a cross-sectional view of one embodiment of a receiver.

FIG. 5 illustrates a cross-sectional view of one embodiment of a receiver 112. The receiver 112 includes a receiver plate 302 and an enclosure 304 that defines the receiver slot 122. In another embodiment, the companionway sidewall 114 has an enclosed recess and the enclosure 304 does not have a back. In such an embodiment, the enclosed recess of the sidewall 114 provides the environmental seal for the receiver slot 122.

Surrounding the open edge of the receiver slot 122 is a guide 502. The guide 502 provides a bearing surface for the end of the door 110 as the door edge 610 enters the receiver slot 122. In various embodiments the guide 502 is a polyethylene material, such as a high-density polyethylene material or an ultra-high-molecular weight polyethylene (UHMW) material. Such material provides good wear resistance and a low coefficient of friction, allowing easy engagement of the door 110 with the receiver 112. In one embodiment, the guide 502 has rounded edges to guide the end 610 of the door 110 into the receiver slot 122. In another embodiment, the guide 502 has a taper or ramp that guides the end 610 of the door 110 into the receiver slot 122.

The guide 502 is dimensioned to provide a close fit with the door 110. In this way, vibrations or movement of the door 110 while under way are minimized. The depth of the receiver slot 122 is sufficient to hold the door edge 610 captive in the receiver 112 and to ensure that the edge 610 is fully inserted into the receiver slot 122 given equipment tolerances and variations due to limit switch tolerances.

Figure 6:
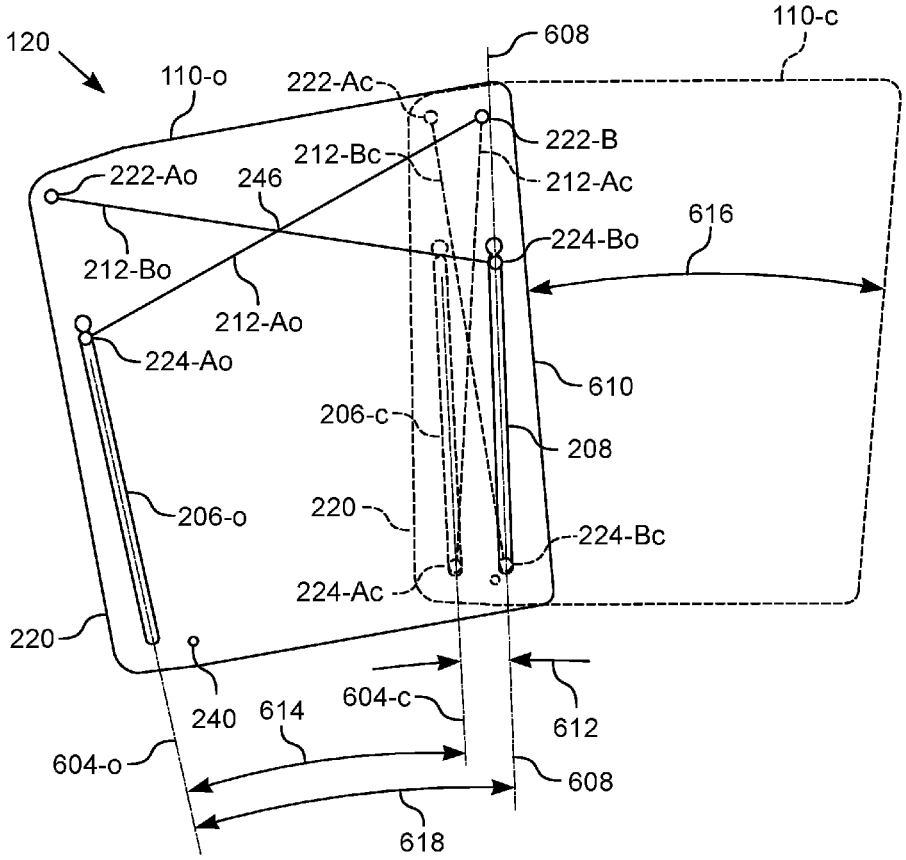
FIG. 6 is a symbolic view of the door mechanism.

FIG. 6 illustrates a symbolic view of the door mechanism 120. The door 110 is depicted in the open position 110-*o* with solid lines and the closed position 110-*c* with dashed lines, and the struts 212 are shown in the open position 212-Ao, 212-Bo with solid lines and the closed position 212-Ac, 212-Bc with dashed lines.

With the door 110 in the open position 110-*o*, the struts 212-Ao, 212-Bo are aligned with the rollers 224-Ao, 224-Bo near the top of the slots 206-*o*, 208. As the door 110 moves to the closed position 110-*c*, the rollers 224-A, 224-B move down their respective slots 206, 208 until the rollers 224-Ac, 224-Bc approach the bottom of the slots 206-*c*, 208. The drive actuator 214 provides the motive force to move the struts 212-A, 212-B rotationally relative to each other. As the struts 212 rotate, the rollers 224-A, 224-B move downward in the slots 206, 208, thereby forcing the door 110 to move from the open position 110-*o* to the closed position 110-*c*.

Each of the slots 206, 208 define a longitudinal axis 604, 608. The angle 614 between the longitudinal axis 604-*o*, 604-*c* of the position of the slot 206 in the open position 206-*o* and the closed position 206-*c* defines a door mechanism angle 614. The door mechanism angle 614 is the angle through which the door 110 moves between the open and closed positions 110-*o*, 110-*c*. A door swing angle 616 is defined by the angle between the distal edge 610 of the door 110 at the door open position 110-*o* and the door closed position 110-*c*. The door mechanism angle 614 is equal to the door swing angle 616.

In the illustrated embodiment, the longitudinal axis 608 of the slot 208 in the frame 204 is substantially parallel 612 with the door slot 206 in the closed position 206-*c*. In the illustrated embodiment, the distance between the two pivots 222-Ac, 222-B and the two rollers 224-Ac, 224-Bc with the door 110 in the closed position 110-*c* are equal because the struts 212-A, 212-B pivot about their center at the actuator output 246. With the door 110 in the open position 110-*o* the door slot 206-*o* and the frame slot 208 subtend an angle 618. The subtended angle 618 is substantially equal to the door mechanism angle 614. In the illustrated embodiment, angles 614, 618 are acute angles. An acute angle is an angle greater than zero degrees and less than 90 degrees. Because the angles 614, 618 are acute angles, the edge 220 of the door 110 moves downward with the door 110 tilting as the door 110 moves from the closed position 110-*c* to the open position 110-*o*. This downward movement of the door edge 220 allows for clearing the deck 126 for those boats 128 that have decks 126 that slope downward from the centerline of the boat 128.

It is to be noted that the longitudinal axis 608 of the slot 208 in the frame 204 does not pass through the center of the pivot 222-B on the frame 204. In the illustrated embodiment, the frame slot 208 is positioned close to the frame plate 216 so as to accommodate the two thicknesses 234, 236 of the frame supports 406, which provides clearance for the inside strut 212-A when it moves to the closed position 212-Ac. In another embodiment, the outer strut 212-B is spaced away from the side supports 406, such as with a spacer between the roller 224-A, 224-B and the strut 212-B.

When the door swing angle 616 is substantially the same as the angle between the companionway sidewalls 114, the distal edge 610 with the door open 110-*o* will be substantially parallel with the plane of the adjacent companionway sidewall 114 when the distal edge 610 with the door closed 110-*c* is substantially parallel with the plane of the opposite companionway sidewall 114. In this way the distal edge 610 of the door 110 will not protrude into the companionway bulkhead opening 104 and the stroke, or travel distance, of the door 110 between the open and closed positions is minimized. Furthermore, the door 110 in the open position 110-*o* is angled downward away from the bulkhead opening 104, which avoids interfering with the typical downward slope of the deck 126 adjacent the drive mechanism 120.

The door swing angle 616 is determined by the location of the pivots 222-A, 222-B and the slots 206, 208. For an embodiment where the actuator output 246 is equidistant from each pivot 222-A, 222-B and roller 224-A, 224-B, the pivots 222-A, 222-B and the rollers 224-A, 224-B each define one corner of a rectangle. For embodiments where the actuator output 246 is not equidistant from each pivot 222-A, 222-B and roller 224-A, 224-B, the pivots 222-A, 222-B and the rollers 224-A, 224-B each define one corner of a trapezoid. One method of determining the location of the pivots 222-A, 222-B and the slots 206, 208 is to first set the length of the struts 212-A, 212-B and select positions for the pivots 222-A, 222-B. With the door 110 in the closed position 110-*c*, the positions for the rollers 224-Ac, 224-Bc are identified on the door 110-*c*, and the frame 204. With the door 110 in the open position 110-*o*, the position of the rollers 224Ao, 224-Bo are identified on the door 110 and frame 204. The door slot 206 extends between the identified positions of the roller 224-Ac, 224-Ao and the frame slot 208 extends between the identified positions of the roller 224-Bc, 224-Bo.

Figure 7:
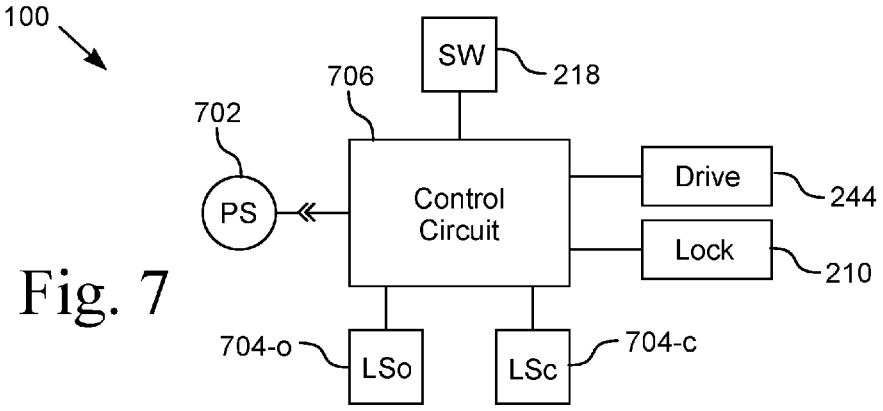
FIG. 7 is a functional block diagram of one embodiment of the electrical system for the door system.

FIG. 7 illustrates a functional block diagram of one embodiment of the electrical system for the door system 100. The electrical control system includes a connection to a power supply 702, a set of limit switches 704-*o*, 704-*c*, an operating switch 218, a drive 244, a locking mechanism 210, and a control circuit 706 connecting the various components. A power supply 702, such as a battery on the boat 128, is connected to the control circuit 706 through a connector.

A switch 218 operates the door system 100. In one embodiment, the switch 218 is a momentary contact pushbutton located on the frame 204. The switch 218 toggles the direction of the drive 244, depending upon the current position of the door 110. In other embodiments, one or more switches 218 are located at convenient locations on the vessel 128 and wired to the control circuit 706.

A pair of limit switches 704-*o*, 704-*c* detect the position of the door 110. The open limit switch 704-*o* detects when the door 110 is in the open position 110-*o*. The closed limit switch 704-*c* detects when the door 110 is in the closed position 110-*c*. In one embodiment the limit switches 704-*o*, 704-*c* are mechanically operated switches that are actuated by physical engagement with the door 110. In one such embodiment shown in FIG. 2, switch 704-*o* is actuated by the roller 224-B in the open position 224-Bo and switch 704-*c* is actuated by the roller 224-B in the closed position 224-Bc. In other embodiments, the switches 704-*o*, 704-*c* are magnetic, proximity, or other types of switches that sense the location of the door 110. In yet another embodiment, the limit switches 704-*o*, 704-*c* are torque sensors that determine when the door 110 has reached its travel limits by monitoring the torque or power required to move the door 110. A torque sensor 704-*c* has the added benefit of detecting an obstruction in the path of the door 110 when it is moving toward the closed position 110-*c*.

The lock, or locking mechanism, 210 is connected to the control circuit. In one embodiment the locking mechanism 210 includes a solenoid with a plunger 410. Energizing the solenoid in the lock 210 causes the plunger 410 to change position to either extended or retracted. In the extended position the plunger 410 engages a hole 240 in the door 110, thereby locking the door 110 in a fixed position relative to the frame 204 on which the locking mechanism 210 is mounted. In the retracted position the plunger 410 is held in the locking mechanism 210 such that clearance is provided between the plunger 410 and the door 110, thereby allowing the door 110 to move between its open position 110-*o* and its closed position 110-*c*.

A drive, or drive motor, 244 is connected to the control circuit. In one embodiment the drive motor 244 is an electrical motor mechanically connected to an output shaft 246 where rotation of the motor's driven element causes the output 246 to rotate. In one such embodiment the drive 244 includes a stepper motor that is operated to move the door 110 to the desired positions. In such an embodiment, the control circuit 706 performs the function of the limit switches 704-*o*, 704-*c* through control of the stepper motor.

In various embodiments, the control circuit 706 is one of a hardwired circuit, a specialized device, or a computer for implementing the functions of the door system 100. The control circuit 706, in one embodiment, is a hardwired circuit that operates the lock 210 and drive 244 based on the switch 218 and the limit switches 704. In other embodiments the control circuit 706 includes a programmable logic controller (PLC), a micro-controller, application specific integrated circuit (ASIC), or other processing unit that executes instructions to control the outputs 210, 244 based on the inputs 218, 704.

Figure 8:
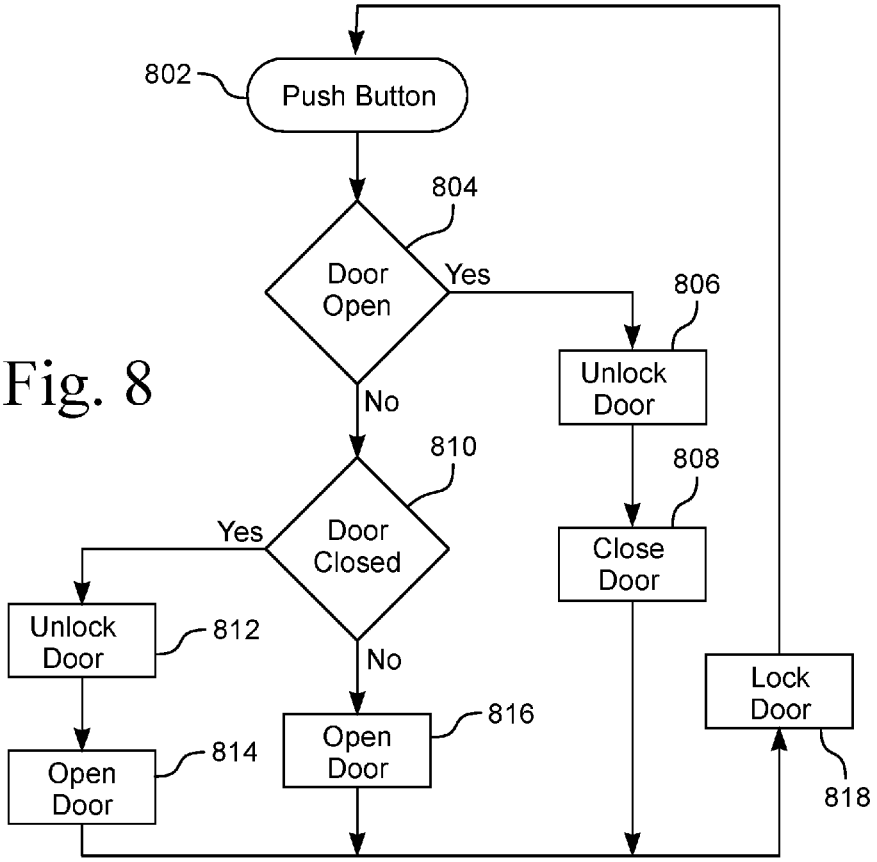
FIG. 8 is a flow chart for one embodiment of a door system.

FIG. 8 illustrates a flow chart for one embodiment of a door system 100. To operate the door system 100, the first step 802 is to push the button, or the switch, 218. Doing so initiates the process of opening or closing the door 110. The next step 804 after the step 802 of pushing the button 218 is to determine if the door 110 is open. If the door 110 is in the open position 110-*o*, the step 806 of unlocking the door 110 is performed, followed by the step 808 of closing the door 110. Step 818 to lock the door 110 is performed before the system 10 waits for the next press of the push button 802. Step 806 of unlocking the door 110 includes energizing the locking mechanism 120 to cause the plunger 410 to disengage the hole 240-*o* in the door 110, thereby releasing the door 110 for movement to the closed position 110-*o*.

The step 808 of closing the door 110 includes energizing the drive mechanism 120 to rotate the struts 212-A, 212-B in the appropriate direction relative to each other. The step 808 of closing the door 110 also includes de-energizing the drive mechanism 120 when the door 110 is determined to be in the closed position 110-*c*, for example, when the limit switch LSc 704-*c* determines that the door 110 is in the closed position 110-*c*. With the door 110 in the closed position 110-*c*, step 818 of locking the door 110 includes energizing the locking mechanism 210 to cause the plunger 410 to engage the hole 240 in the door 110, thereby securing the door 110 in the closed position 110-*c*.

If step 804 to determine if the door 110 is open determines that the door 110 is not open, then step 810 to determine if the door 110 is closed is performed. If the door 110 is in the closed position 110-*c*, the step 812 of unlocking the door 110 is performed, followed by step 814 of opening the door 110. Step 818 to lock the door 110 is performed before the system 10 waits for the next press of the push button 802. Step 812 of unlocking the door 110 includes energizing the locking mechanism 210 to cause the plunger 410 to disengage the hole 240 in the door 110, thereby releasing the door 110 for movement to the open position 110-*o*. The step 814 of opening the door 110 includes energizing the drive mechanism 120 to rotate the struts 212-A, 212-B in the appropriate direction relative to each other to cause the door to open. The step 814 of opening the door 110 also includes de-energizing the drive mechanism 120 when the door 110 is determined to be in the open position 110-*o*, for example, when the limit switch LSo 704-*o* determines that the door 110 is in the open position 110-*o*. With the door 110 in the open position 110-*o*, step 818 of locking the door 110 includes energizing the locking mechanism 210 to cause the plunger 410 to engage the hole 240-*o* in the door 110, thereby securing the door 110 in the open position 110-*o*.

If step 810 to determine if the door 110 is closed determines that the door 110 is not closed, then step 816 to open the door 110 is performed. This situation occurs when the door 110, for some reason, is in neither the full open position 110-*o* nor the full closed position 110-*c*. In such a case the door 110 is moved to a known position, such as the illustrated full open position 110-*o*. In another embodiment the step 816 moves the door 110 to the full closed position 110-*c*. In either case, step 818 to lock the door 110 is performed before the system 100 waits for the next press of the push button 802. With the door 110 in the open position 110-*o*, step 818 of locking the door 110 includes energizing the locking mechanism 210 to cause the plunger 410 to engage the hole 240-*o* in the door 110, thereby securing the door 110 in the open position 110-*o*.

The door system 100 includes various functions. The function of moving the door 110 such that the distal edge 610 aligns with the companionway sidewalls 114 when in the open position 110-*o* and the closed position 110-*c* is implemented by the drive mechanism 120. In one embodiment, the drive mechanism 120 includes an actuator 214 driving a scissors mechanism 212-A, 212-B that engages a pair of slots 206, 208. The slots 206, 208 are not parallel such that when the door slot 206 moves from the open position 206-*o* to the closed position 206-*c*, the position change subtends an angle 614 that is equal to the angle subtended by the edge 610 of the door 110 as it moves laterally from the open position 110-*o* to the closed position 110-*c*.

The function of locking the door 110 in the closed position 110-*c* is implemented, in one embodiment, by the plunger 410 of the locking mechanism 210 engaging the hole 240 that is aligned with the plunger 410 in the closed position 110. Energizing the locking mechanism 210 causes the plunger 410 to engage the hole 240, thereby locking the door 110 in position.

The function of locking the door 110 in the open position 110-*o* is implemented, in one embodiment, by the plunger 410 of the locking mechanism 210 engaging the hole 240-*o* that is aligned with the plunger 410 in the open position 110. Energizing the locking mechanism 210 causes the plunger 410 to engage the hole 240-*o*, thereby locking the door 110 in position.

From the foregoing description, it will be recognized by those skilled in the art that an automated companionway door system 100 has been provided. A door 110 is moved laterally from an open position 110-*o* to a closed position 110-*c* where the edge 610 of the door 110 is parallel to the adjacent companionway sidewall 114 when the door 110 is in the open position 110-*o* and the closed position 110-*c*.

The function of reducing vibration and movement of the door 110 is implemented in various embodiments by the guides 402, 502 in the frame opening 404 and the receiver recess 122, respectively. The guides 402, 502 are strips of material that are wear resistant with a low coefficient of friction. In another such embodiment, the guides 402, 502 are resilient so as to minimize water intrusion into the frame opening 404 and the receiver recess 122, respectively.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for selectively opening and closing a bulkhead opening that has non-parallel sidewalls, said apparatus comprising:

a panel having a distal edge and a second edge opposite said distal edge, said panel having a first slot proximate said second edge;

a frame having a frame panel configured to attach to a first sidewall of the bulkhead opening, said frame panel having an opening dimensioned to permit passage of a portion of said panel between said distal and second edges, said panel having a first position whereby said distal edge is substantially parallel with a surface of said frame panel with said distal edge proximate said frame panel, said panel having a second position whereby said distal edge extends beyond said surface of said frame panel, said distal edge at said first position and said distal edge at said second position defining an acute angle therebetween, said frame having a second slot on a frame support extending from said frame panel;

a first strut having a first pivot at a first end and a first roller at a second end of said first strut, said first pivot attached to said frame support whereby said first strut is rotatable relative to said frame support about said first pivot, said first roller engaging said first slot in said panel whereby said first roller is movable along said first slot;

a second strut having a second pivot at a first end and a second roller at a second end of said second strut, said second pivot attached to said panel proximate said second edge whereby said second strut is rotatable relative to said panel about said second pivot, said second roller engaging said second slot in said frame support whereby said second roller is movable along said second slot;

an actuator connected to said first and second struts whereby said actuator causes said first and second struts to rotate relative to each other about a center of rotation of each one of said first and second struts, said actuator causing said panel to move between said first position and said second position; and a receiver having a receiver panel and a receiver slot, said receiver panel configured to attach to a second sidewall of the bulkhead opening, said receiver slot dimensioned to receive said distal edge of said panel when said panel is in said second position.

2. The apparatus of claim 1 wherein said first slot in said panel has a first longitudinal axis orientation when said panel is in said first position and said first slot has a second longitudinal axis orientation when said panel is in said second position, said first and second longitudinal axis orientations defining a door swing angle substantially equal to said acute angle.

3. The apparatus of claim 1 wherein said actuator includes a motor and a gear reduction unit with an associated housing, said associated housing attached to one of said first and second struts, and an output of said gear reduction unit attached to the other one of said first and second struts whereby said first strut rotates relative to said second strut about said output of said gear reduction unit.

4. The apparatus of claim 1 further including a first switch detecting said first position of said panel and a second switch detecting said second position of said panel, said first and second switches electrically connected to said actuator to selectively de-energize said actuator when said panel is in said first position and said second position, respectively.

5. The apparatus of claim 1 further including an operating switch electrically connected to a control circuit that selectively energizes said actuator to move said panel to one of said first position and said second position.

6. The apparatus of claim 1 further including a locking mechanism attached to said frame and a locking hole in said panel, said locking hole positioned to be aligned with a plunger extending from said locking mechanism when said panel is in said second position.

7. The apparatus of claim 1 wherein said receiver further includes a bearing strip attached inside said receiver slot proximate an edge of said receiver slot that is proximate said receiver panel.

8. The apparatus of claim 1 wherein said frame includes a bearing strip attached inside said opening between said panel and a surface of said opening whereby said bearing strip centers said panel in said opening in said frame panel.

9. An apparatus for selectively opening and closing a bulkhead opening that has sidewalls, said apparatus comprising:

a panel having a distal edge and an inside edge opposite said distal edge;

a frame configured to attach to a first side of the bulkhead opening, said frame having an opening dimensioned for said distal edge of said panel to pass through said opening;

a receiver configured to attach to a second side of the bulkhead opening, said second side opposite said first side, said receiver having a receiver slot dimensioned and configured to receive said distal edge of said panel; and a drive mechanism attached to said frame and said panel, said drive mechanism selectively moving said panel between an open position and a closed position, whereby said open position has said distal edge proximate said frame and said distal edge being substantially parallel to a surface of said frame, and whereby said closed position has said distal edge extending beyond said frame, said distal edge at said open position and said distal edge at said closed position defining a door swing angle therebetween; wherein said panel includes a panel slot proximate said inside edge, said frame includes a frame slot, and said drive mechanism includes a first roller and a second roller, wherein said first roller engages said panel slot, and said second roller engages said frame slot, and said drive mechanism operates to change a distance between said first and second rollers to cause said panel to move between said open position and said closed position.

10. The apparatus of claim 9 wherein said drive mechanism further includes a first strut and a second strut, said first strut having a first pivot at a first end and said first roller at a second end of said first strut, said first pivot attached to said frame support whereby said first strut is rotatable relative to said frame support about said first pivot, said first roller engaging said panel slot whereby said first roller is movable along said first slot; and said second strut having a second pivot at a first end and said second roller at a second end of said second strut, said second pivot attached to said panel proximate said inside edge whereby said second strut is rotatable relative to said panel about said second pivot, said second roller engaging said frame slot whereby said second roller is movable along said second slot.

11. The apparatus of claim 10 wherein said drive mechanism further includes an actuator connected to said first and second struts, whereby said actuator causes said first and second struts to rotate relative to each other.

12. The apparatus of claim 11 further including a first switch detecting said open position of said panel and a second switch detecting said closed position of said panel, said first and second switches electrically connected to said actuator to selectively de-energize said actuator when said panel is in said open position and said closed position, respectively.

13. The apparatus of claim 11 further including an operating switch electrically connected to a control circuit that selectively energizes said actuator to move said panel to one of said open position and said closed position.

14. The apparatus of claim 9 further including a locking mechanism attached to said frame and a locking hole in said panel, said locking hole positioned to be aligned with a plunger extending from said locking mechanism when said panel is in said closed position.

15. An apparatus for selectively opening and closing a bulkhead opening that has non-parallel sidewalls, said apparatus comprising:

a panel having a first edge and a second edge, said panel having a panel slot adjacent said first edge, said panel slot having a first longitudinal axis;

a frame having a frame plate and a first side support, said frame plate having an opening dimensioned to receive said second edge and permit passage of said panel, said frame having a frame slot with a second longitudinal axis, said first and second longitudinal axes defining an acute angle when said panel is in a first position, wherein said first position has said second edge of said panel proximate said opening in said frame plate and said second edge is substantially parallel with a surface of said frame plate, said panel having a second position whereby said second edge extends beyond said surface of said frame panel, said second edge at said first position and said second edge at said second position defining an acute angle therebetween;

a receiver having a recess dimensioned to receive said second edge of said panel; and a drive mechanism attached to said frame, said drive mechanism attached to said panel proximate said first edge, said drive mechanism engaging said frame slot and said panel slot, said drive mechanism causing said panel to move between said first position and said second position relative to said frame.

16. The apparatus of claim 15 wherein said drive mechanism further includes a first strut and a second strut, said first strut having a first end pivotally attached to said frame, said first strut having a second end attached to a first roller engaging said panel slot, said second strut having a first end pivotally attached to said panel proximate said first edge, and said second strut having a second end attached to a second roller engaging said frame slot.

17. The apparatus of claim 16 wherein said acute angle is determined by a position of each one of said first end of said first strut, said first end of said second strut, said panel slot, and said frame slot.

18. The apparatus of claim 16 wherein said drive mechanism further includes a drive with a rotating output, each one of said drive and said rotating output attached to a corresponding one of said first and second struts whereby said first strut rotates relative to said second strut when said drive is energized.

19. The apparatus of claim 18 further including a first switch detecting said first position of said panel and a second switch detecting said second position of said panel, said first and second switches electrically connected to said actuator to selectively de-energize said actuator when said panel is in said first position and said second position, respectively.

* * * * *